US007086991B2

(12) United States Patent
Williams et al.

(10) Patent No.: US 7,086,991 B2
(45) Date of Patent: Aug. 8, 2006

(54) ROPE CLIMBING SIMULATOR

(76) Inventors: Michael Edward Williams, 2459 N. Heartyside, Orange, CA (US) 92865; Darryl Bassani, 5727 Grand View, Yorba Linda, CA (US) 92886

( * ) Notice: Subject to any disclaimer, the term of this patent is extended or adjusted under 35 U.S.C. 154(b) by 170 days.

(21) Appl. No.: 10/199,551

(22) Filed: Jul. 19, 2002

(65) Prior Publication Data

US 2004/0014568 A1 Jan. 22, 2004

(51) Int. Cl.
*A63B 7/04* (2006.01)
*A63B 21/00* (2006.01)
*A63B 21/06* (2006.01)

(52) U.S. Cl. ..... 482/37; 482/51; 482/93

(58) Field of Classification Search ..... 482/37, 482/51, 93, 99, 114, 120, 35–36
See application file for complete search history.

(56) References Cited

U.S. PATENT DOCUMENTS 3,782,718 A * 1/1974 Saylor ..... 482/37
4,161,998 A * 7/1979 Trimble ..... 182/190
4,512,570 A 4/1985 Tardivel
5,044,632 A 9/1991 Jones
5,050,873 A 9/1991 Jones
D321,026 S 10/1991 Jones
D321,027 S 10/1991 Jones
5,060,938 A 10/1991 Hawley, Jr.
D321,387 S 11/1991 Jones
D321,389 S 11/1991 Jones
D321,391 S 11/1991 Jones
5,066,003 A 11/1991 Jones
5,076,574 A 12/1991 Johnson, Jr.
5,106,080 A 4/1992 Jones
5,125,881 A 6/1992 Jones
5,135,449 A 8/1992 Jones
5,135,456 A 8/1992 Jones
5,171,198 A 12/1992 Jones
5,180,354 A 1/1993 Jones
5,181,896 A 1/1993 Jones
5,273,504 A 12/1993 Jones
5,273,505 A 12/1993 Jones
5,380,258 A * 1/1995 Hawley, Jr. ..... 482/37
5,484,360 A * 1/1996 Haber et al. ..... 482/37
5,484,365 A 1/1996 Jones et al.
5,496,234 A 3/1996 Sussich
5,554,084 A 9/1996 Jones
5,554,089 A 9/1996 Jones
5,554,090 A 9/1996 Jones
RE35,470 E 3/1997 Jones
5,788,615 A 8/1998 Jones (Continued)

FOREIGN PATENT DOCUMENTS

FR 2682604 A1 * 4/1993

*Primary Examiner*—Gregory L. Huson
*Assistant Examiner*—Fenn C. Mathew
(74) *Attorney, Agent, or Firm*—Stetina Brunda Garred & Brucker

(57) ABSTRACT

The present invention relates to a rope climbing simulator system for allowing a user to simulate ascending and descending rope climbing exercises therewith. The system includes a bead chain of serially connected beads. Each of the beads defines a palmar support portion graspable by the user's hands for moving the bead chain in downward and upward directions. A resistance mechanism is in mechanical communication with the bead chain for providing resistance to the bead chain. The bead chain and the resistance mechanism cooperate to impart flexion of the user's muscles during the exercises.

20 Claims, 9 Drawing Sheets

U.S. PATENT DOCUMENTS 6,010,437 A 1/2000 Jones
6,099,439 A 8/2000 Ryan et al.
6,176,814 B1 1/2001 Ryan et al.
6,261,208 B1 * 7/2001 Carson, Jr. ..... 482/37

* cited by examiner

Fig. 4
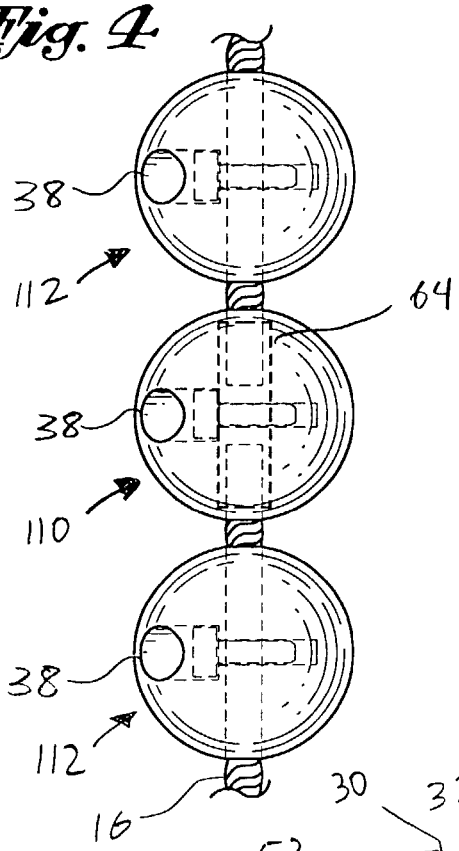
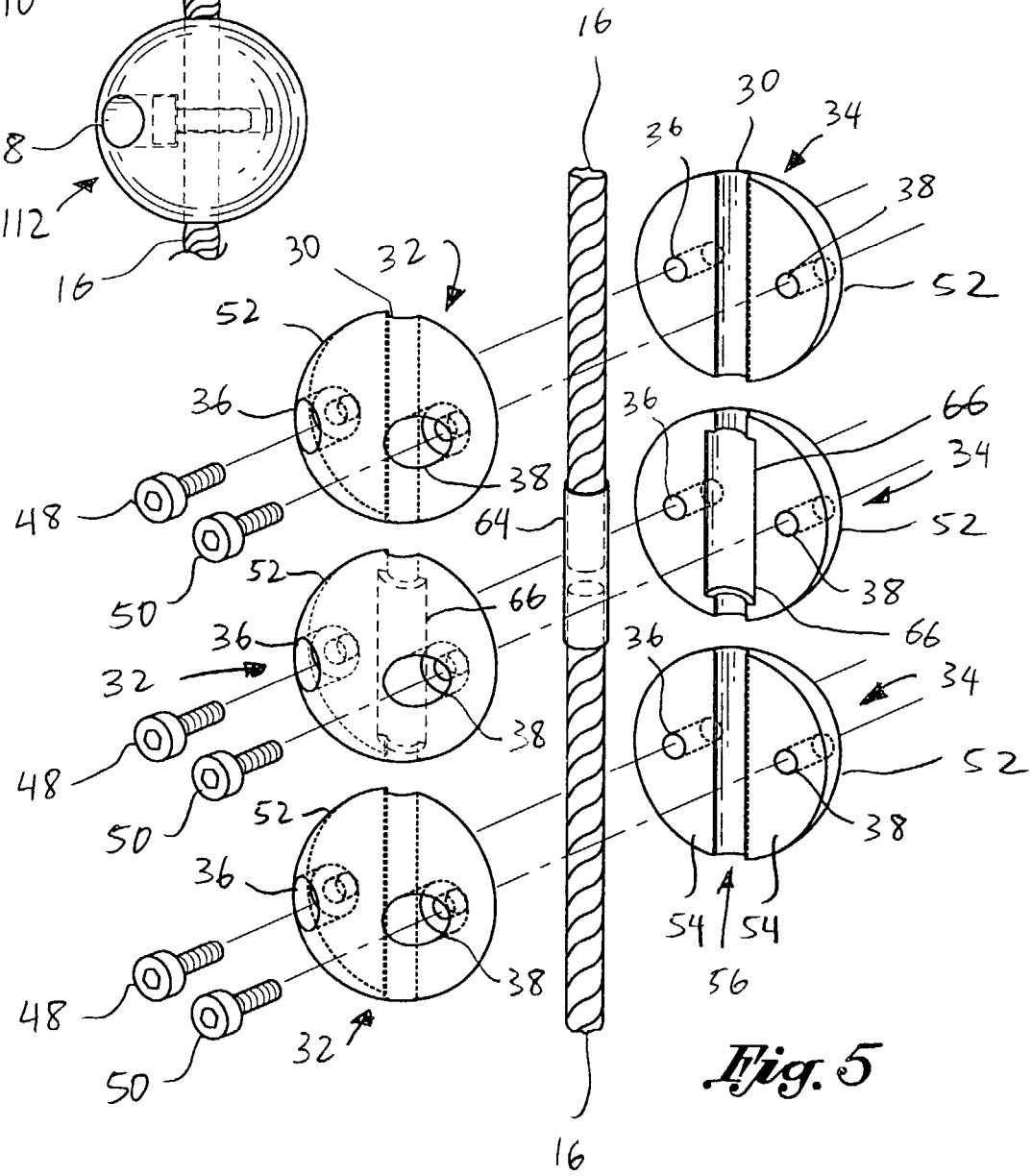
Fig. 5

ROPE CLIMBING SIMULATOR

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to the field of exercise devices, more particularly to rope climbing simulators for allowing a user to simulate ascending and descending rope climbing exercises therewith.

The rope climb is one of the historical exercises employed by the military, schools and gymnasiums for building upper body strength. Typically, the rope is suspended from the ceiling or another stationary object. The rope is generally thick and sometimes includes a series of knots to assist the user in gripping the rope at spaced points. The rope climb is considered to be an effective tool for training the upper body because the user is required to support his or her entire weight while climbing to the top of the rope. Descending the rope also provides as much upper body training to the user.

Gripping a rope to support one's entire weight is very difficult to perform. Typically, athletes who have had a history of extensive upper body training can climb a rope. However, weaker individuals may find it difficult to even begin the rope climbing exercise, and gain associated training benefits. Also, some other weaker individuals may only be able to climb up the rope a short distance before they have to slide or drop from the rope. As such, these attempts at the rope climb may be difficult and unsafe without prior upper body training.

A standard rope climbing exercise does not provide any selectable weight assistance or resistance for the user. The user must be able to support their entire body weight without assistance. Moreover, the rope used in the rope climb is typically a coarse, thick, weave of strands providing a large cylindrical surface for the user to grip in their hands. Such thick ropes are generally coarse, and over time, strands of the rope may protrude therefrom and irritate the hands of the user. Additionally, such ropes are generally formed having a weaved configuration such that the user is able to effectively grip the rope. However, continual use of such a rope will not only irritate the user's hands but may even cause rope-burn from engaging and disengaging the rope too quickly. Additionally, sweat or moisture can make the user slip off the rope. Thus, there are several disadvantageous aspects of rope climbing which severely limit most users from performing the rope climb safely and generally causes damage to the user's hands.

Accordingly, there is a need for a rope climb simulator which allows a user to perform substantially the same exercise as accomplished by engaging in a conventional rope climbing exercise, without the aforementioned disadvantageous effects.

BRIEF SUMMARY OF THE INVENTION

The present invention specifically addresses and alleviates the above-identified deficiencies in the art. In this regard the present invention overcomes such deficiencies in the prior art by providing a novel system which allows the user to select the amount of resistance, provides comfortable hand-grippable beads, and allows the user to simulate both ascending and descending rope pull exercises therewith. In this respect, the system provides a safe device for allowing a user to simulate a rope pull exercise and obtain the benefits therefrom without risking undue injury or strain upon the body.

There is a long-felt need for a rope climbing simulator which is sturdy, safe and constructed of high quality components for daily use in professional and home gymnasiums. The present invention provides for an ideal device which is extraordinarily comfortable for users and immediately appeals to users of all body types, shapes and experience due to the user-friendly design of the present invention. While the prior art rope climbing device is uncomfortable and dangerous due to the distance above the ground the user must ascend, the present invention minimizes the chance of injury by eliminating the need for a user to ascend high in the air to perform an exercise. Additionally, if the user should become too tired to complete the rope climbing exercise, the user may simply disengage the device without fear of any injury to themself or the added embarrassment of not being able to complete the exercise as is apparent in a conventional rope climbing exercise.

As an additional benefit, the present invention allows the user to simulate at least two exercises: an ascending rope climb and a descending rope climb. By selecting a desired amount of resistance via resistance weights or other forms of resistance, the user may perform either or both of the exercises using a single machine. As will be appreciated by those skilled in the art, the ascending and descending exercises provide training and resistance to different parts of the upper body. However, generally, the present invention is useful in allowing a user to target specific portions of the body for toning. For example, the user has the option of using the simulator to isolate training to one arm, one hand, both arms, or both hands. This may be especially useful for physical therapy patients who may require targeted muscle exercises in a specific portion of the body yet are otherwise unable to perform conventional exercises. Among the muscles exercised via the system include finger muscles, the various forearm muscles, biceps, triceps, abdomen, and back muscles. Thus, the present invention provides for a comfortable, safe and novel system for alleviating such deficiencies in the prior art.

In accordance with the present invention, there is provided a rope climbing simulator system for allowing a user to simulate ascending and descending rope climbing exercises therewith. The system includes a bead chain formed of a plurality of serially connected beads. Each of the beads define a palmar support portion graspable by the user's hands for moving the bead chain in downward and upward directions. A resistance mechanism is placed in mechanical communication with the bead chain. The resistance mechanism provides resistance to the bead chain by counteracting and urging downward and upward movements of the bead chain respectively. The bead chain and the resistance mechanism cooperate to impart flexion of first and second sets of the user's muscles during the ascending and descending rope climbing exercises respectively.

More specifically, the palmar support portion may be formed having a substantially spherical configuration to accommodate the user's fingers and hands. The palmar support portion may also define an elastomeric palmar support surface thereabout for providing traction to the user's fingers and hands.

Further, the first set of muscles may include deep flexor muscle of fingers, superficial flexor muscle of fingers, ulnar flexor muscle of wrist, short flexor muscle of little finger, short flexor muscle of thumb, long flexor muscle of thumb, adductor muscle of thumb, palmar interosseous muscles, pronater muscles, brachial muscle, brachioradial muscle, latissimus dorsi muscle, tricep muscles of arm, and pectoral muscles. The second set of muscles may include deep flexor muscle of fingers, superficial flexor muscle of fingers, ulnar flexor muscle of wrist, short flexor muscle of little finger, short flexor muscle of thumb, long flexor muscle of thumb, adductor muscle of thumb, palmar interosseous muscles, pronater muscles, brachial muscle, bradioradial muscle, biceps muscle of arm, deltoid muscle, trapezius muscle, and scapula. In essence, the simulated ascending rope climbing exercise and the descending rope climbing exercise are each advantageous in toning at least two sets of muscles which have common muscles yet are each advantageous in toning muscles specific to those exercises.

In accordance with the present invention, the system may further include first and second rope pulleys disposed in generally spaced relation. The first rope pulley may be disposed above the second rope pulley so as to allow the bead chain to travel therebetween. Each of the first and second rope pulleys may define a seating recess formed about at least an outer portion thereof. In particular, the seating recess may define a pair of inner walls parallely disposed to face each other. The inner walls may define an intermediate surface extending perpendicularly therebetween. The inner walls and the intermediate surface may be collectively formed to receive the bead chain within the seating recess during rotational movement thereof.

The intermediate surface of the second rope pulley may define a plurality of bead engagement recesses disposed serially therealong. Each of the bead engagement recesses may be sized and configured to engage a respective one of the beads and may be formed having a recess bottom and a substantially circular engagement rim. The recess bottom and engagement rim may define an arcuately continuous portion therebetween for allowing the beads to roll thereinto during rotational movement of the bead chain.

More particularly, the system may further include a plurality of rope segments connecting each of the beads. In this respect, the intermediate surface may define a plurality of rope grooves formed between each of the bead engagement recesses. Each of the rope grooves may be formed having a groove depth at a radial-most portion of the intermediate surface so as to accommodate a lowest portion of the rope segments during rotational movement of the bead chain.

In accordance with the present invention, the system may further include first and second resistance pulleys rotatably mounted in generally spaced relation. In particular, the resistance mechanism may include a resistance weight placeable into mechanical communication with at least one of the first and second resistance pulleys for providing the resistance. The resistance mechanism may further include a resistance belt/cable having first and second belt ends. The first belt end may be attached to one of the first and second resistance pulleys and the second belt end may be attached to the resistance weight. The spacing and/or relative orientation (e.g. angle) of the pulleys may be selectively regulated to further vary rope pull resistance to the user.

Further, one of the first and second rope pulleys may be formed having a winding member for receiving the resistance belt therearound so as to provide progressively increasing and decreasing resistance to the user during the downwards and upwards movements of the bead chain respectively. The winding member may be rotatable in both clockwise and counter-clockwise directions. The winding member may include a substantially cylindrical rod axially attached thereto and attached to one of the first and second rope pulleys.

Alternatively, the rope climbing simulator may include first and second rope pulleys rotatably mounted in generally spaced relation. An exercise rope may be disposable between the first and second rope pulleys. A bead chain formed of a plurality of serially connected beads may be disposed in substantially end-to-end relation about the rope along at least a portion thereof. Each of the beads may have a multi-piece configuration so as to be detachable from the exercise rope. Each of the beads may define a palmar support portion graspable by the user's hands for moving the bead chain in downward and upward directions. A resistance mechanism may be placed in mechanical communication with the bead chain. The resistance mechanism may provide resistance to the bead chain by counteracting and urging downward and upward movements of the bead chain respectively. The bead chain, the exercise rope, the first and second rope pulleys and the resistance mechanism may cooperate to impart flexion of first and second sets of the user's muscles during the ascending and descending rope climbing exercises respectively.

Further, at least a portion of each bead may define a rope-engaging aperture. To serially connect the beads, the rope-engaging aperture may be formed to receive the exercise therethrough. At least a portion of each bead adjacent the rope-engaging aperture may be formed from a substantially rigid metallic material, e.g. alumninum or steel. Each bead may further include first and second respective bead portions. Each of the first and second bead portions may define at least one fastener hole perpendicularly formed with respect to the rope-engaging aperture. At least one fastener may be insertable through the at least one fastener hole of the first and second bead portions so as to fixedly engage the first and second bead portions to each other over the exercise rope. Each bead may be formed having male and female connectors for serially connecting each of the beads together, the male connector of each bead being matable engageable to the female connector of each bead.

BRIEF DESCRIPTION OF THE DRAWINGS

These as well as other features of the present invention will become more apparent upon reference to the drawings wherein:

FIG. 4 is a plan view of the master and filler tooling beads attached to the rope;

FIG. 5 is an exploded view of the master and filler tooling beads attached to the rope;

DETAILED DESCRIPTION OF THE INVENTION

The detailed description, as set forth below in connection with the appended drawings, is intended as a description of the presently preferred embodiments of the invention, and is not intended to represent the only form in which the present invention may be constructed or utilized.

Figure 1:
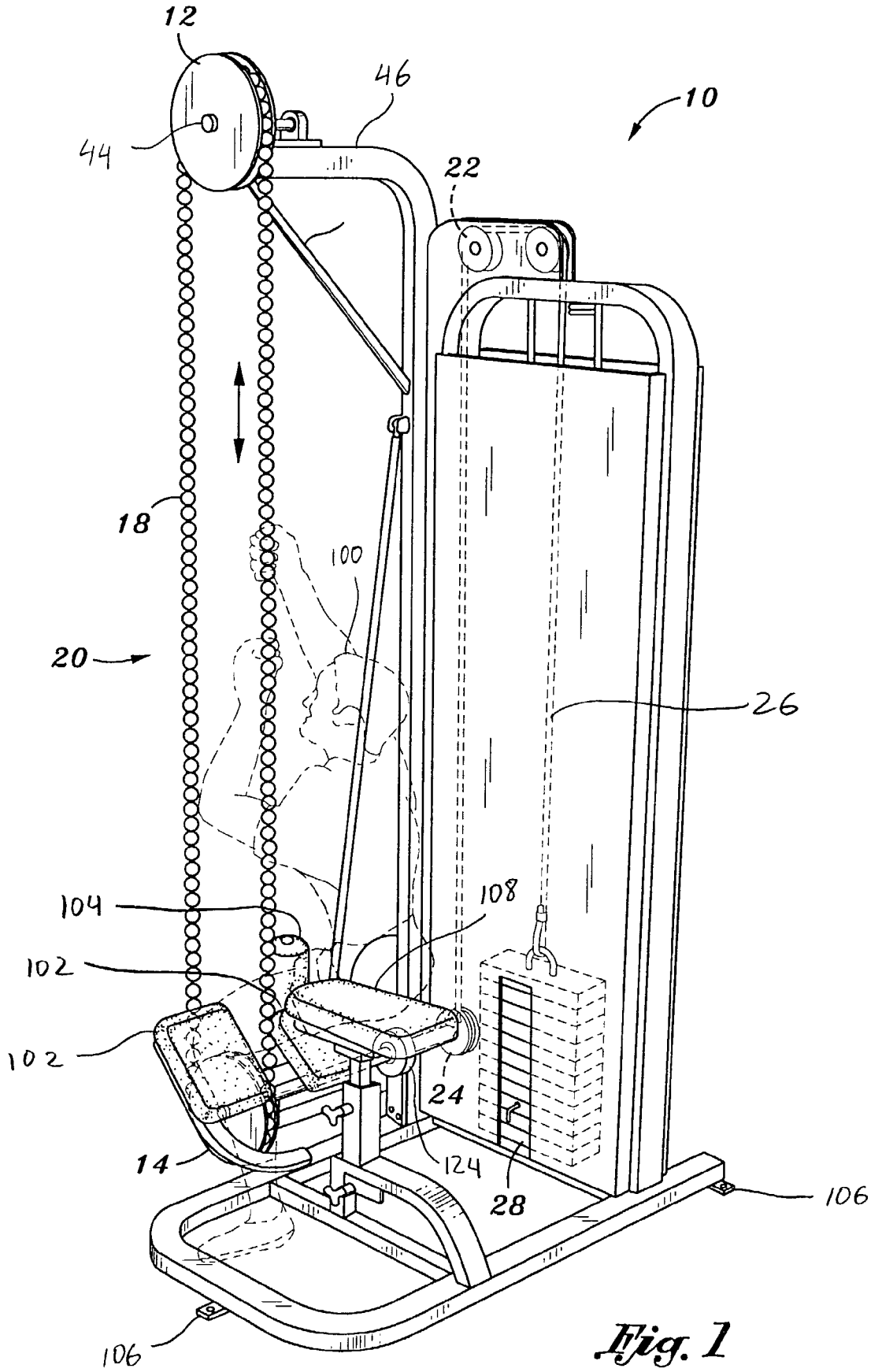
FIG. 1 illustrates the rope climb simulator system in use by a user, the user grasping a portion of the bead chain while seated.

Referring now to the drawings wherein the showings are for the purposes of illustrating preferred embodiments of the present invention only, and not for the purposes of limiting the same, FIG. 1 illustrates the rope climbing simulator system 10 made in accordance with the present invention. More specifically, there is provided a rope climbing simulator system 10 for allowing a user 100 to simulate ascending and descending rope climbing exercises therewith. As described herein, ascending rope climbing exercises include actions by the user 100 which simulate climbing a conventional rope. In this respect, ascending shall include hand-over-hand motions exerting downward force as if to lift the user's body upwards. By contrast, descending shall include hand-over-hand motions to substantially support the user's weight or to prevent the bead chain 20 from propelling upwards. Such exercises should preferably be performed while sitting but may be performed while standing. The bead chain 20 may be formed of a plurality of serially connected beads 18. Preferably, the beads 18 are formed having a substantially spherical configuration such that each of the beads 18 are hand-holdable and graspable by the user's hands and fingers. In this respect, each of the beads 18 defines a palmar support portion which is generally the outermost portion of the bead 18. Each bead 18 should be sized to be approximately the size of a golf ball. However, the bead 18 may be larger or smaller than such a size so long as the user 100 is able to properly grasp the beads 18 while serially connected to each other to form the bead chain 20.

Figure 3:
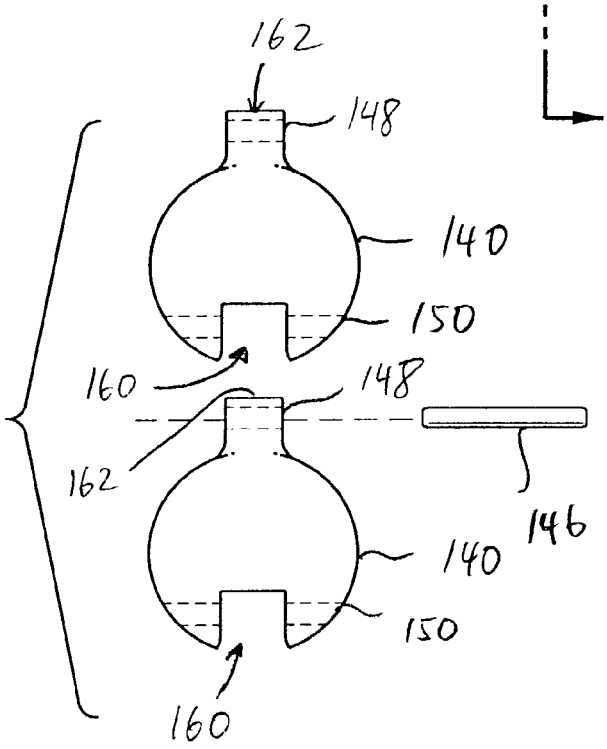
FIG. 3 is a plan view of the linkable beads.
Figure 3B:
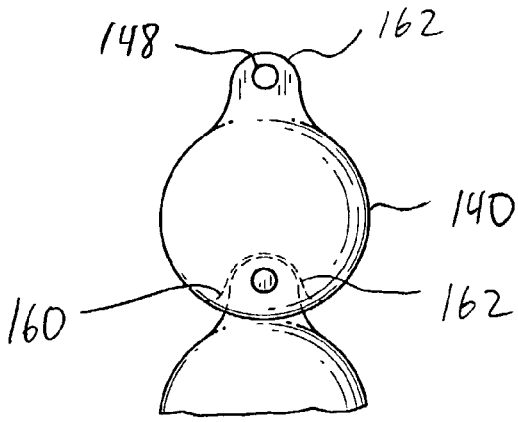
FIG. 3B is a plan view of the linkable beads illustrated in FIG. 3A taken along line 3B—3B.
Figure 3A:
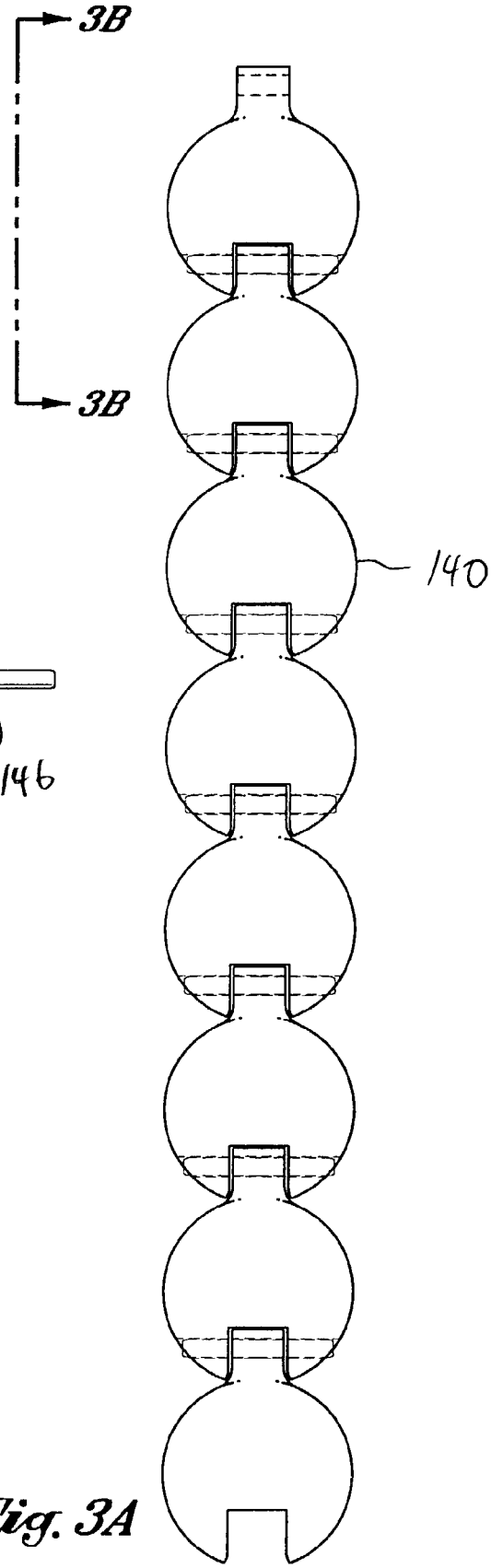
FIG. 3A is a plan view of the linkable beads.
Figure 6:
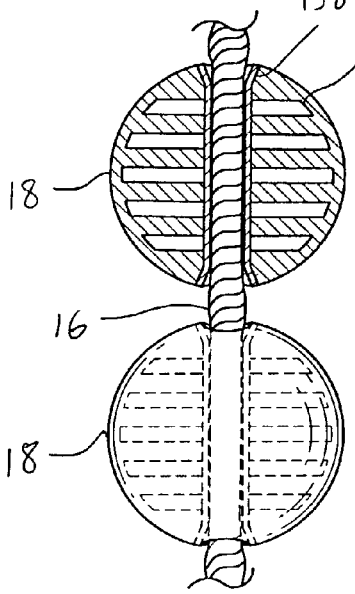
FIG. 6 is a plan view of the beads having a support liner and attached to the rope.
Figure 7:
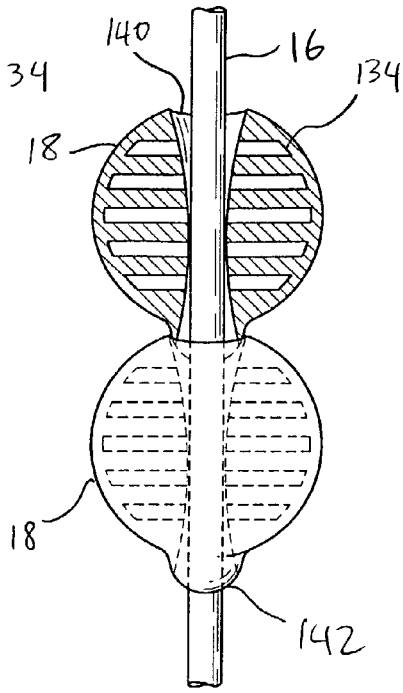
FIG. 7 is a plan view of the beads being attached to the rope.
Figure 7A:
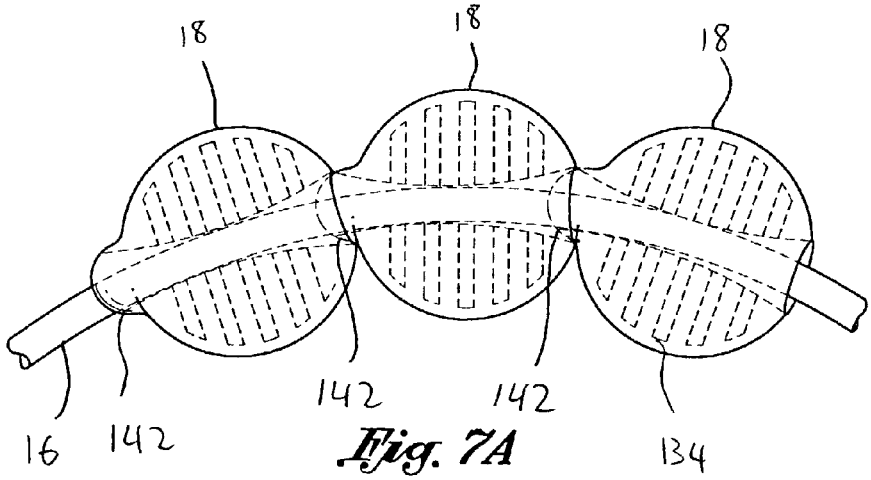
FIG. 7A is a plan view of the beads illustrates in FIG. 7 engaging each other during rotation of one of the first and second rope pulleys.

As used herein, serially connected shall include substantially end-to-end arrangement of the beads 18 as shown in FIGS. 7 and 7A, interlocking arrangement of the beads 18 as shown in FIGS. 3, 3B, and 3A, and shall additionally include arrangements where the beads 18 are spaced apart at locations on the rope so as to form a gap between each of the beads 18 as shown in FIG. 6. In this respect, it is not necessary for the bead chain 20 to include an underlying rope 16 or other element for the bead chain 20 to work with the system. As described herein, the rope 16 shall also include cables fabricated from metal materials and other elongated members which are sufficiently flexible to accommodate the beads 18 and capable of withstanding a high degree of force placed thereupon by the user 100 during simulated exercises.

The rope climbing simulator system 10 may include first and second rope pulleys 12 and 14 rotatably mounted in generally spaced relation. Preferably, the rope pulleys 12 and 14 are fixedly mounted to a frame 46 via a hub 44 as shown in FIG. 1. The frame 46 should be formed of a rigid metallic material such as steel which provides a support structure to maintain at least one of the rope pulleys 12 and 14 fixed thereon yet rotatable about the hub 44. However, the frame 46 may be fabricated from other materials, e.g. plastic, or alternatively, no frame 46 may be provided such that the rope pulleys 12 and 14 are attached to other structures and objects to maintain the rope pulleys 12 and 14 in fixed positions.

Preferably, the first rope pulley 12 is disposed at a higher distance above the ground than the second rope pulley 14. Even more preferably, the second rope pulley 12 is disposed at a location adjacent a ground surface. Most preferably, the first rope pulley 12 is disposed above the second rope pulley 14. In this respect, as shown in FIG. 1, the first and second rope pulleys 12 and 14 may be disposed in diametrically opposed positions. As further shown by FIG. 1, when a user 100 simulates the ascending rope climbing exercise by applying downward force upon a section of the bead chain 20, the first and second rope pulleys 12 and 14 are caused to rotate in tandem. Thus, if for example, the user 100 were to pull down on the bead chain 20 as shown in FIG. 1, the first and second rope pulleys 12 and 14 may turn in the same direction. Therefore, the first and second rope pulleys 12 and 14 function to turn in tandem when force is applied to the bead chain 20.

As shown in FIG. 1, the user 100 may sit upon a seat 108 mounted to a portion of the frame 46 while resting the user's knees upon knee rests 102. To prevent the user 100 from slipping from the seat 108 while performing the exercises with the present invention, a crotch support 104 may be provided which is positioned adjacent the seat 108 and placed in perpendicular relation thereto. Preferably, the seat 108 is positioned to be slanted downward toward the bead chain 20 and may be adjustable by the user 100 depending on body size. It is also preferred that the user 100 will sit upon the seat 108 to simulate the rope climb. However, the user may also stand and grasp the bead chain 20 to simulate both ascending and descending rope climbing exercises therewith. To ensure that the frame 46 does not slip or otherwise move while the user 100 is simulating exercises, mounting brackets 106 may be provided on a lower portion of the frame 46 for securing the frame 46 to a ground surface.

Figure 1A:
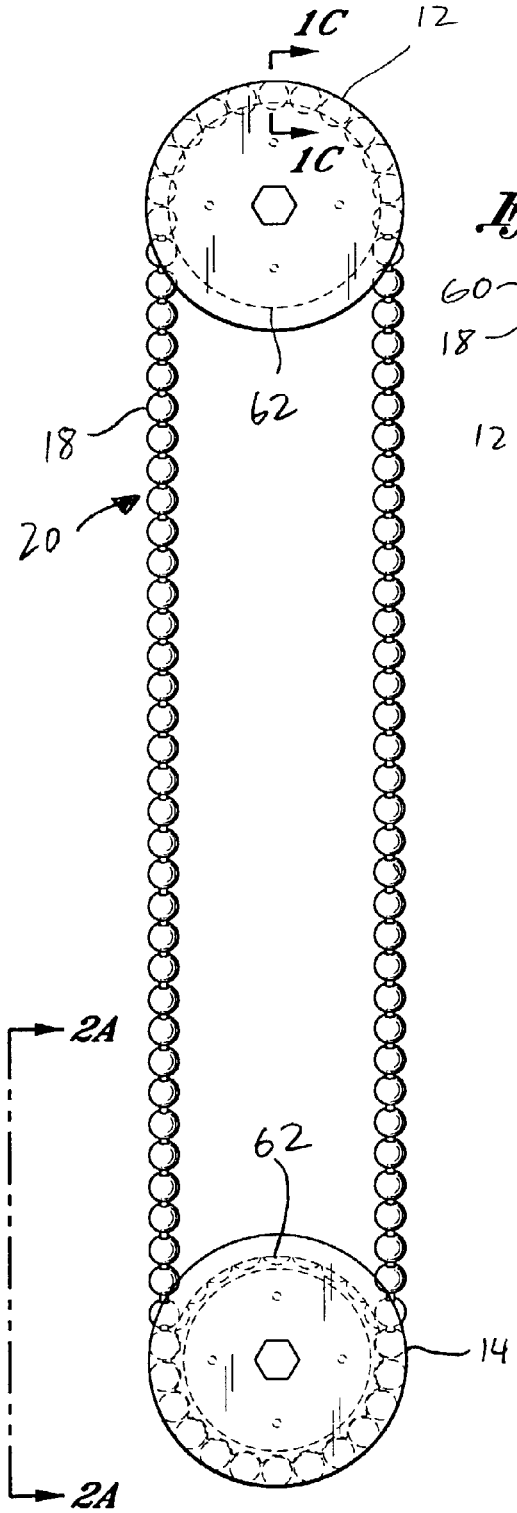
FIG. 1A is a plan view of the first and second rope pulleys having the bead chain attached thereto.
Figure 1C:
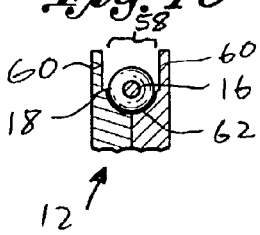
FIG. 1C is a cross-sectional view of the first rope pulley taken along line 1C—1C of FIG. 1A.
Figure 1B:
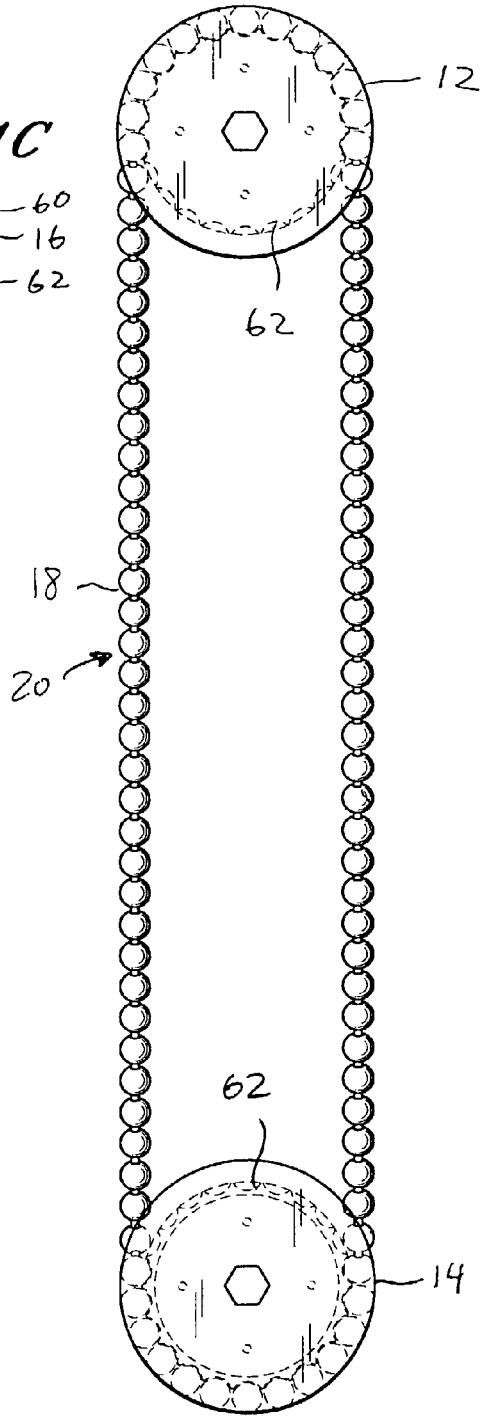
FIG. 1B is a plan view of the first and second rope pulleys having the bead chain attached thereto.

As shown in FIGS. 1A and 1C, there is provided a preferred embodiment of the present invention whereby the bead chain 20 is engaged to both the first and second rope pulleys 12 and 14. Preferably, the first rope pulley is formed having a seating recess 58 about at least an outer portion thereof. The seating recess 58 may define a pair of inner walls 60 disposed in parallel relation to face each other. The inner walls 60 may define an intermediate surface 62 extending perpendicularly therebetween. The inner walls 60 and the intermediate surface 62 may be collectively formed to receive the bead chain 20 within the seating recess 58 during rotational movement thereof. Preferably, the intermediate surface 62 is formed having a substantially smooth surface for allowing the beads 18 to pass through uninhibited. In this respect, there should not be any structures which retain the beads 18 in specific positions along the first rope pulley 12 and rather allows the beads 18 to freely move around the first rope pulley 12. Such a substantially smooth surface allows the bead chain 20 be retained between the inner walls 60 during rotational movement of the first rope pulley 12. However, as shown in FIG. 1B, the first rope pulley 12 may also be formed such that the intermediate surface 62 additionally includes bead engagement recesses 40 which are more particularly described and shown in FIGS. 2A, 2B, 2C, and 2D.

With respect to FIGS. 2A, 2B, 2C, and 2D, the second rope pulley 12 is illustrated as made according to the present invention. However, it is anticipated that either the first rope pulley 12 or the second rope pulley 14 could either individually or collectively contain the features as shown in FIGS. 2A, 2B, 2C and 2D.

Figure 2A:
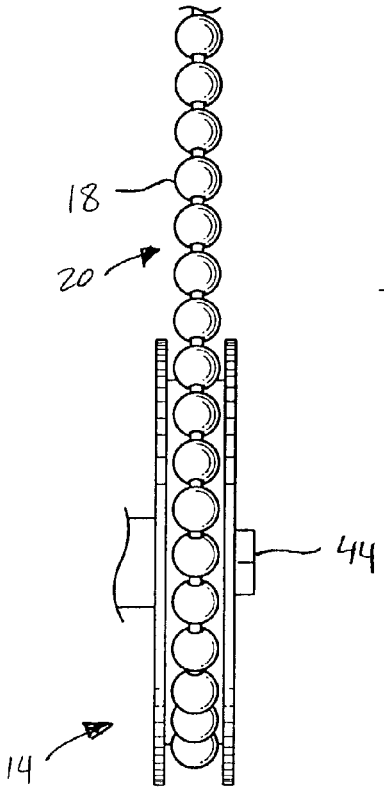
FIG. 2A is a plan view of the second rope pulley attached to the frame and having the bead chain attached thereto.
Figure 2B:
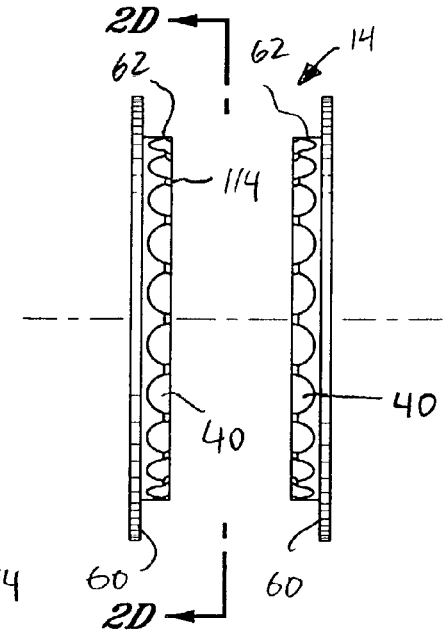
FIG. 2B is a plan view of the second rope pulley split into respective halves.
Figure 2C:
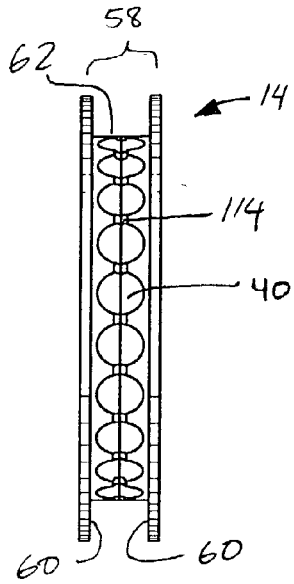
FIG. 2C is a plan view of the second rope pulley without the bead chain attached thereto.
Figure 2D:
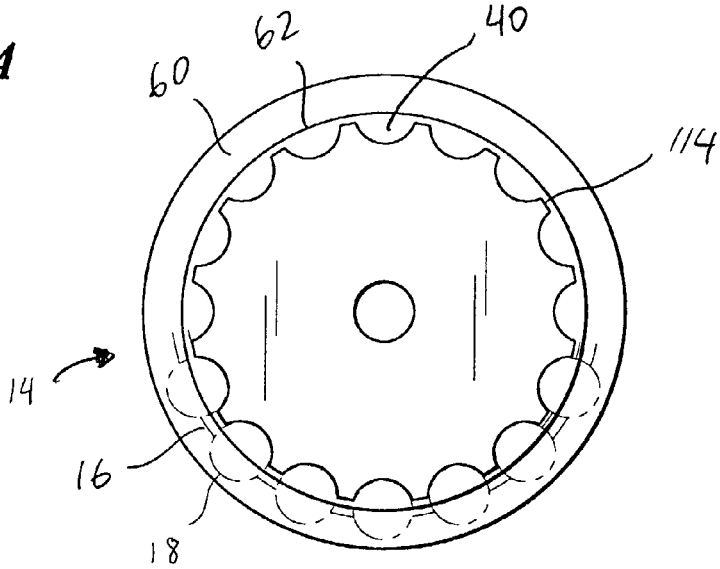
FIG. 2D is a plan view of the present invention taken along line 2D—2D of FIG. 2B illustrating the second rope pulley.

Advantageously, as shown in FIGS. 2A, 2B and 2C, the second rope pulley 14 may define a seating recess 58 formed about at least an outer portion thereof. The seating recess 58 may define a pair of inner walls 60 disposed in parallel relation to face each other. The inner walls 60 may define an intermediate surface 62 extending perpendicularly therebetween. The inner walls 60 and the intermediate surface 62 may be collectively formed to receive the bead chain 20 within the seating recess 58 during rotational movement thereof. Each of the inner walls 60 may define a plurality of bead engagement recesses 40 disposed serially therealong. Each of the bead engagement recesses 40 being sized and configured to engage a respective one of the beads 18. In this respect, the beads 18 may be retained within the seating channel 58 during rotational movement of the pulleys 12 and 14 via the bead engagement recesses 40 disposed on the inner walls 60, thereby preventing the bead chain 20 from extruding or slipping out from the seating recess 58 during rotational movements. Thus, as shown in FIGS. 2A, 2B, 2C, and 2D, the bead engagement recesses 40 may pull the beads 18 downwards and feed them around the pulley 14 during rotational movement. The advantageous effect is to prevent individual beads 18 from slipping out of the seating recess 58 as increasing force is applied upon the bead chain 20.

The bead engagement recesses 40 formed on the intermediate surface 62 may be formed having a recess bottom and a substantially circular engagement rim. The recess bottom and engagement rim may define an arcuately continuous portion therebetween for allowing the beads 18 to roll thereinto during rotational movement of the bead chain 20. In this respect, rather than providing a sharp edge for the beads, the arcuately continuous portion may provide a smooth and continuous manner of allowing the beads 18 to travel through the seating recess 58 without destroying the bead 18.

Figure 8:
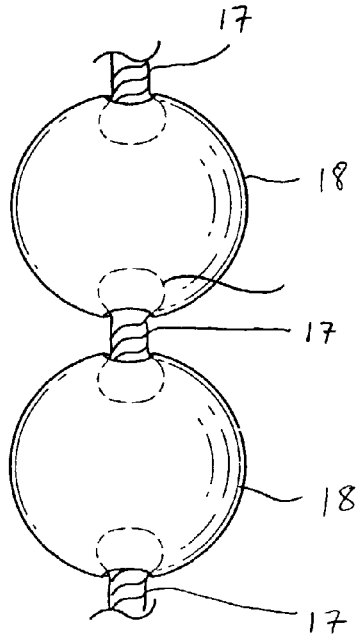
FIG. 8 is a plan view of the beads being joined together via rope segments.

Additionally, as shown in FIG. 8, a plurality of rope segments 17 connecting each of the beads 18 may be provided. While FIG. 5 depicts an elongated exercise rope 16 as may be used with the present invention, the plurality of rope segments 17 may be formed to be attached to each of the beads 18 such that the rope segments 17 link the individual beads 18 together and form the bead chain 20.

The intermediate surface 62 may also define a plurality of rope grooves 114 formed between each of the bead engagement recesses 40. Each of the rope grooves 114 may be formed having a groove depth at a radial-most portion of the intermediate surface 62 so as to accommodate a lowest portion of the rope segments 17 or portions of the rope 16 during rotational movement of the bead chain 20. In this respect, the rope grooves 114 provide guidance and alignment of the individual beads 18 as they pass over the pulley and through the seating recess 58. Such rope grooves 114 may then correct slight misalignments in the bead chain 20 as it travels over the pulley 12. Importantly, providing such rope grooves 114 reduces and/or minimizes damage to the rope which may ordinarily result in the absence thereof. More specifically, during rotational movement of the second rope pulley 14, rapid rotation and/or increased force exerted upon the bead chain 20 may cause the individual beads 18 to misalign and/or become damaged. Providing the rope grooves 114 provides a space where the rope 16 and/or rope segments 17 may lie during rotation of the second rope pulley 14 and prevent beads 18 from popping out of the bead engagement recesses 40 or bunching up from misalignments. Preferably, the rope grooves 114 should be sized and configured to accommodate the rope 16 and/or other connecting members which may be used to serially connect the beads 18 together to form the bead chain 20.

A resistance mechanism may be placed in mechanical communication with the bead chain 20. The resistance mechanism provides resistance to the bead chain 20 by counteracting and urging downward and upward movements of the bead chain 20 respectively. Such mechanical communication shall include fixed attachment, removable attachment, and both direct and indirect connections to the bead chain 20. Preferably, the resistance mechanism includes first and second resistance pulleys 22 and 24 rotatably mounted in generally spaced relation. The resistance pulleys 22 and 24 and preferably positioned so as to be diametrically opposing each other. Even more preferably, the first resistance pulley 22 is positioned above the second resistance pulley 24 so as to allow for weights or other objects to be placed thereupon to create resistance.

Figure 1D:
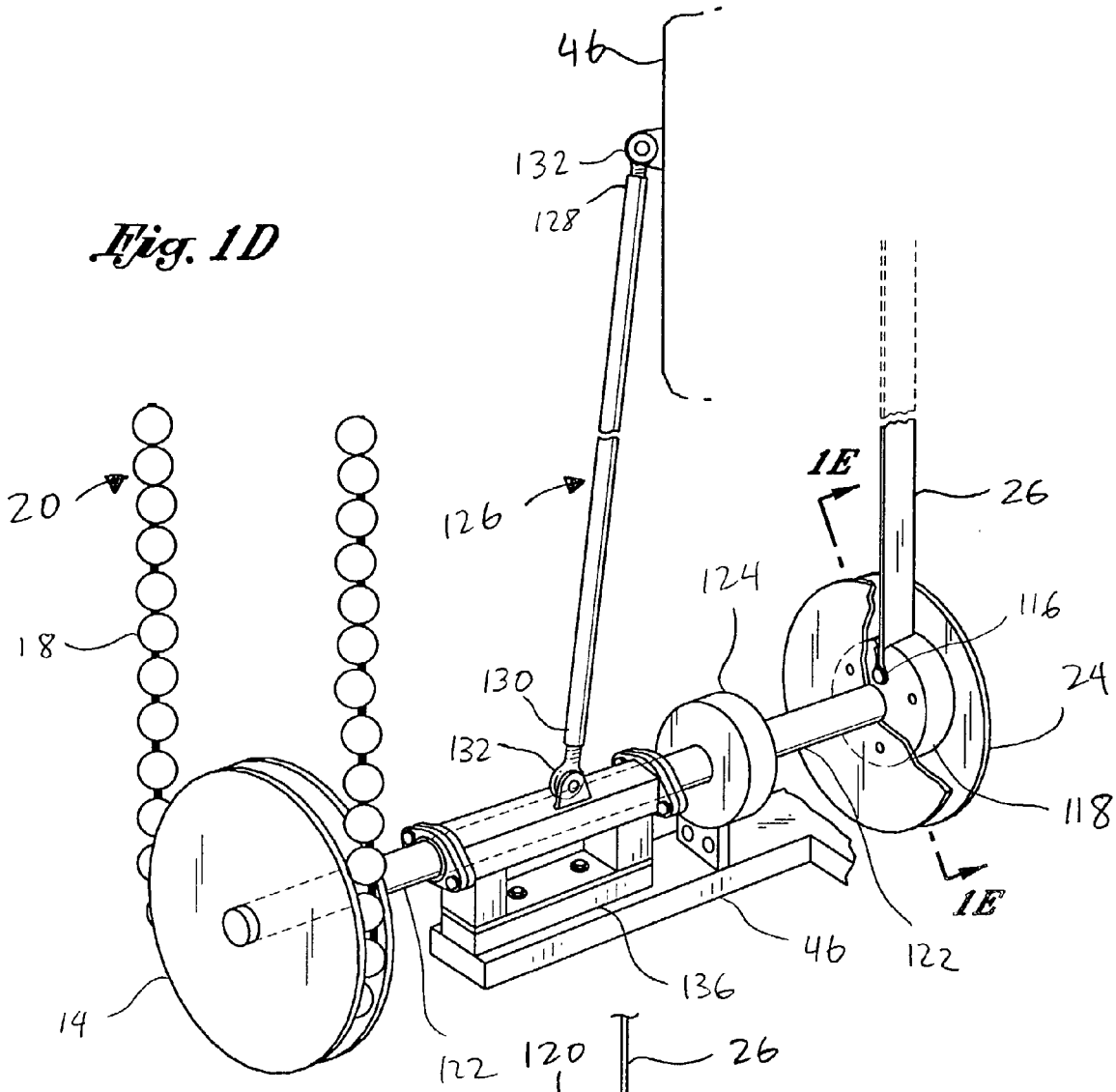
FIG. 1D is a plan view of the present invention illustrating the second rope pulley attached to the second resistance pulley.
Figure 1E:
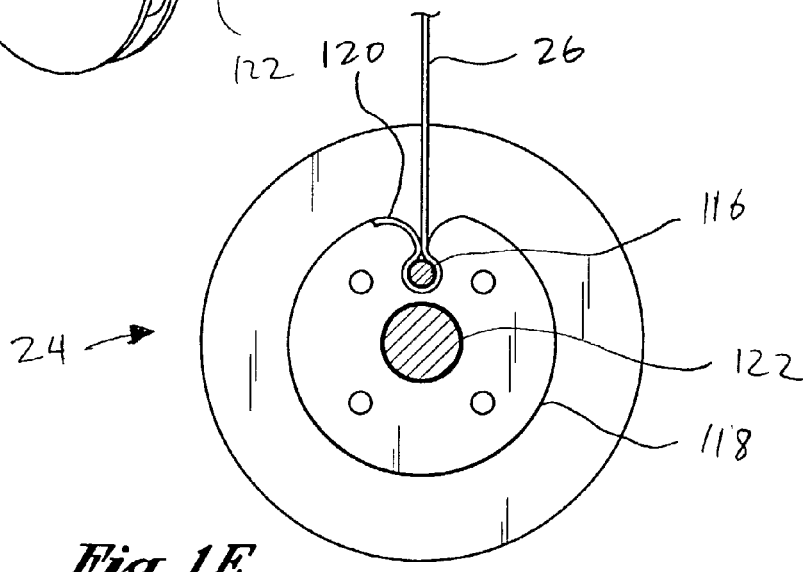
FIG. 1E is a plan view of the present invention taken along line 1E—1E of FIG. 1D illustrating the second rope pulley.

As shown in FIGS. 1D and 1E, a resistance belt 26 may be provided which is engageable with one of the first and second rope pulleys 12 and 14. Preferably, the resistance belt 26 is formed from a material which is non-stretchable, such as a dense Kevlar material, and may additionally be formed as a metal cable or other types of elongated members having high tensile strength capabilities. The resistance belt 26 is engageable with the first and second resistance pulleys 22 and 24. Further, as shown in FIG. 1, at least one resistance weight 28 is preferably attached to the resistance belt 26 so that the resistance weight 28 is suspendable from one of the first and second resistance pulleys 22. Thus, resistance is provided to the bead chain 20 via use of the aforementioned devices. Alternatively, additional resistance pulleys may be employed to direct the feed of the resistance belt 26 to suspend the resistance weight 28. While it is preferable that the belt 26 be formed of a flexible elongated kevlar material, any other flexible non-stretchable and elongated members may be utilized in place thereof, e.g. cords, cables, and ropes. The user 100 may select the amount of resistance by varying/selecting the number of resistance weights 28 being attached to the belt 26. Advantageously, this selectable system allows the user to perform a rope climbing exercise by using less than their entire weight as is required with the conventional rope climb. The resistance belt 26 is preferably fabricated so as to provide sufficient tensile strength when force is exerted thereupon yet is sufficiently flexible to wrap around the resistance pulleys 22 and 24. The belt 26 may be connected to a portion of the second rope pulley 14 such that when force is applied to a portion of the bead chain 20, the first and second rope pulleys 12 and 14 rotate in tandem while invoking the belt 26 to wrap around the second resistance pulley 24. Such force applied upon the bead chain 20 causes the resistance weight 28 to move from a stacked position to an elevated position (not shown). In a stacked position, a plurality of resistance weights 28, e.g. 10 pound increments, may be stacked on top of each other so as to allow the user 100 to select the amount of resistance. In an elevated position, movement of the bead chain 20 downward may raise the selected resistance weight 28 above the ground surface. In this respect, when a user 100 applies force upon the bead chain 20, the weight of the resistance weight 28 is being substantially translated to the bead chain 20. Ideally, the user 100 should select an amount of weight and/or number of resistance weights 28 such that pulling the bead chain 20 causes the user 100 to feel a desirable amount of resistance.

The user 100 may elect to use a sufficient amount of weight and/or number of resistance weights 28 such that grasping the bead chain 20 and simulating the rope climb is performed according to the user's individual ability. In this respect, the user 100 would experience substantially the same exercise as if the user had climbed a rope. However, advantageously, the user would not experience any of the disadvantageous effects of the conventional rope climbing exercise since the use of the beads 18 provide ample support yet do not irritate the user's hands. Additionally, there would be little chance of the user 100 injuring themself from falling as in the conventional rope climbing exercise.

As shown in FIGS. 1D and 1E, the belt 26 may be attached to a portion of one of the first and second rope pulleys 12 and 14 via a pin 116 attached to the end of the belt 26 and secured thereto. The pin ensures that the belt 26 remains fixed to the second rope pulley 26 and further provides a definite end when the user is performing the rope climbing exercise. In this respect, the second rope pulley 26 may include a winding member 118 for receiving the resistance belt 26 therearound which progressively winds up the length of the belt 26 when force is applied upon the bead chain 20 and unwinds thereafter. More specifically, the user may pull up or down on a portion of the bead chain 20 to perform an ascending or descending rope climbing exercise whereby successive downward or upward pulls of the bead chain 20 progressively lifts or drops the resistance weight 28 to a higher or lower distance above the ground surface. Preferably, as shown in FIG. 1E, the belt 26 should be attached to the winding member 118 in a center portion thereof. The belt 26 may be inserted into a portion of the winding member 118 while the pin 116 holds the belt 26 in place. The remaining slack left from the belt 26 may then be tucked away in a belt recess 120 formed along a portion of the winding member 118. In this respect, the belt recess 120 is sized and shaped to substantially correspond to the size and shape fo the belt 26. Additionally, the belt recess 120 may be curved such that the belt 26 may wrap around the winding member 118 without damage or obstruction.

Advantageously, as the belt 26 wraps around the winding member, the resistance tends to increase due to an increase in the diameter of the winding member 118. Preferably, the winding member 118 further includes a substantially cylindrical rod 122 axially attached to one of first and second rope pulleys 12 and 14. The rod 122 should also be axially attached to the winding member 118 to translate rotational motion between the second rope pulley 14 and the second resistance pulley 24. Optionally, one of the first second rope pulleys 12 and 14 is rigidly attached to at least a portion of the second resistance pulley 24 such that the resistance belt 26 extends from the resistance weight 28 and is further engaged with the first and second resistance pulleys 22 and 24. For installation and removal of the rod 122, a pillow block 136 may be attachable to a portion of the frame 46 which is preferably formed having a substantially rectangular shape and a substantially cylindrical cavity for receiving the rod 122 therethrough.

As further shown in FIG. 1D, a clutch 124 may be provided which is attached to a portion of the frame. The clutch 124 may enhance the system 10 by slowing down the resistance weight 28 when the bead chain 20 is released by the user 100. In this respect, as is apparent in most exercise devices, rapid release of the exercise device causes the weight to rapidly crash down and hit the stack of weights. This generally presents a dangerous situation and makes it possible for users to injure themselves from such a rapid crash. The use of the clutch allows the weight 28 to slowly descend or lock completely and provides for a safe and effective method of disengaging the system 10.

The clutch 124 is preferably placed into mechanical communication with a portion of the rod 122. Advantageously, the clutch 124 prevents injuries to the user 100 and others by detecting sudden accelerations in rotational speed by the rod 122 and stopping and/or reducing rotational speed of the rod 122. Since an increase in rotational speed may cause objects to accelerate toward the outer peripheries of a rotating object, the clutch 124 provides a stop mechanism which grasps at least one of a plurality of teeth formed along an inside periphery of the clutch 124 when the rod 122 accelerates too quickly. Since such sudden accelerations in the rod 122 could be caused by the user 100 inadvertently letting go of the bead chain 20 or otherwise allowing the resistance weights 28 to drop, the clutch 124 may activate and prevent injuries.

As also shown in FIG. 1D, a tension adjuster 126 may be attached to a portion of the frame 46. During installation and removal of the bead chain from the body 10, the tension of the bead chain 20 should be adjusted according to preference by the user 100. To accomplish this task, the tension adjuster 126 may be attached to a portion of the frame 46 adjacent the rod 122 and additionally attached to another portion of the frame 46 at a distance above the rod 122. Preferably, the tension adjuster 126 includes an elongated member having first and second threaded ends 128 and 130. At each of the first and second threaded ends 128 and 130, a respective threaded eyelet 132 may be attached thereto. The threaded eyelets 132 may be fixedly engaged to portions of the frame 46. By threadably engaging the tension adjuster 126 to the respective threaded eyelets 132 at the first and second threaded ends 128 and 130, the user 100 may rotate the tension adjuster 126 to provide for selectable increased or decreased tension on the bead chain 20 translated thereto via the second rope pulley 14. Preferably, the tension adjuster 126 may be attached to portions of the frame 46 to form a triangular configuration and function as a gusset. More specifically, the threaded eyelet 132 of the first threaded end 128 is preferably attached to a substantially vertical portion of the frame 46 while the second threaded end 130 is preferably attached to a substantially horizontal portion of the frame 46.

As shown in FIGS. 4 and 5, there is also provided at least one master tooling bead 110. In a preferred embodiment of the present invention, the bead chain 20 is disposed between the first and second rope pulleys 12 and 14. However, to permit installation of the bead chain 20 around the first and second rope pulleys 12 and 14 and to further provide for servicing of the bead chain 20, the at least one master tooling bead 110 may be provided. More specifically, the bead chain 20 is preferably formed by first providing a length of the rope 16. The rope 16 may then be threaded through a plurality of the beads 18, preferably in end-to-end relation as shown in FIGS. 6 or 7, while leaving slack at each end of the rope 16 for closure. As shown in FIG. 5, to form a loop, each end of the rope 16 is then joined via a sleeve 64 which slides over each end of the rope 16. The sleeve 64 should be fabricated to fit snugly over each end of the rope 16 to prevent disconnection thereof. To complete the loop and to ensure that the sleeve 64 remains attached to the rope 16, the at least one master tooling bead 110 may be attached to the rope 16 around the sleeve 64. In this respect, the master tooling bead 110 defines a sleeve cavity 66 which is sized and configured to receive the sleeve 64 fitted around the rope 16. While it is generally necessary for at least one master tooling bead 110 to be utilized in securing the sleeve 64 around the rope 16, it is preferable to utilize an additional two filler tooling beads 112 to fill up slack space adjacent the master tooling bead 110. Allowing for slack space adjacent the master tooling bead 110 allows for more simplified installation and removal of the master tooling bead 110. Thus, the filler tooling beads 112 may then be attached to the rope 16 at locations on the rope adjacent the master tooling bead 110. The filler tooling beads 112 allow a user to remove the filler tooling beads 112 from the rope 16 when servicing the bead chain 20 to create slack space and allow for tools to remove the master tooling bead 110.

Figure 5A:
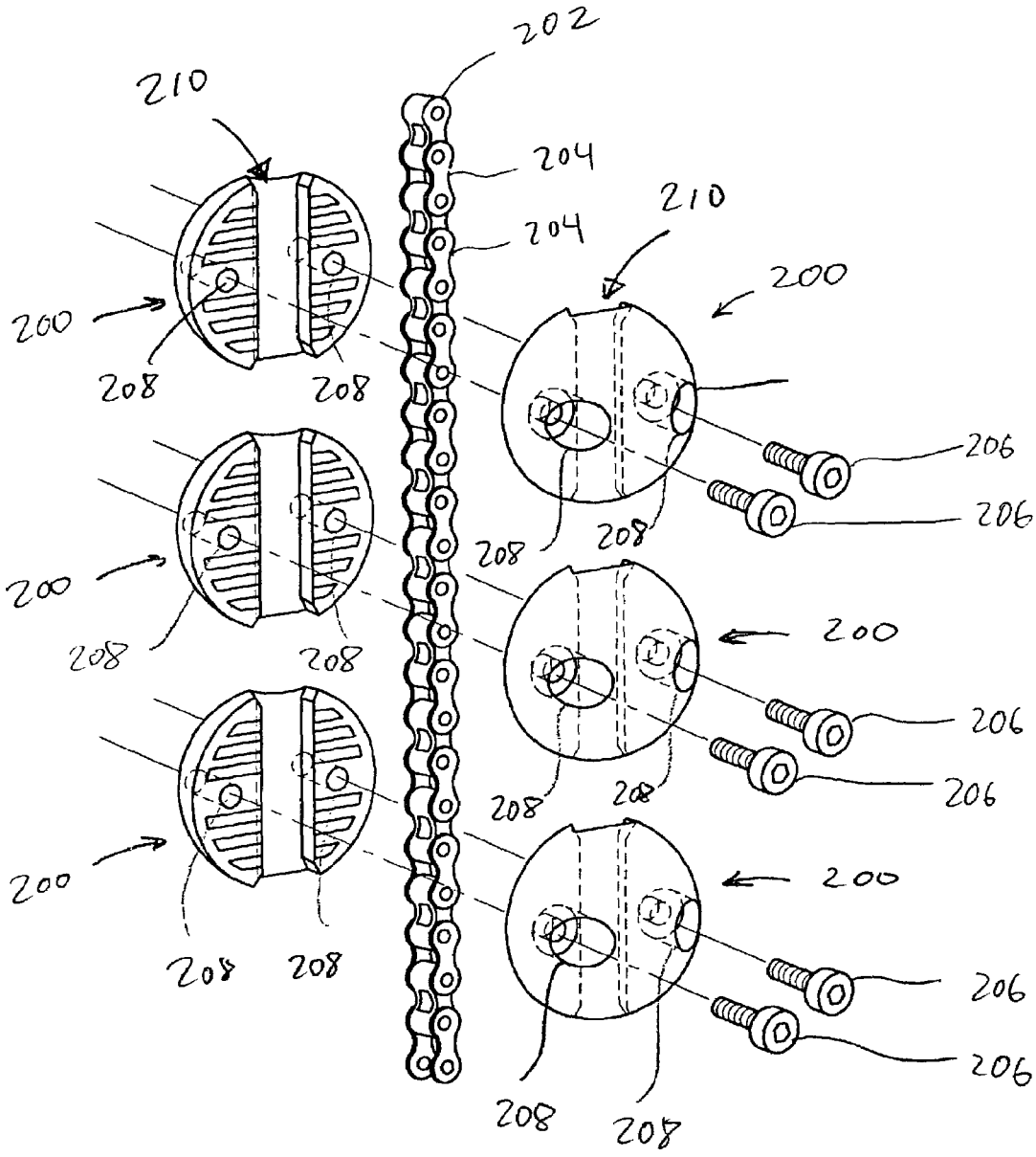
FIG. 5A is an exploded view of the master tooling bead attached to the rope formed as a chain.

As shown in FIG. 5A, a master tooling bead 200 is shown which may be attached to a rope formed as a chain 202. Preferably, the chain 202 is formed from a plurality of links 204 which are pivotally connected to each other in substantially end-to-end relation. Even more preferably, the chain 202 is formed such that each link 204 measures approximately ¼ inch by ¼ inch. In this respect, each of the links 204 are preferably removably attached to each other to permit servicing of the bead chain 20. By providing a chain 202, servicing is even more simplified such that only one master tooling bead 200 may be required to provide a gap in the chain 202 such that tools may remove a link 204 from the chain 202 and subsequently remove and/or replace individuals beads or the chain 202 itself. To allow the master tooling bead 200 to fixedly engage to the chain 202, each bead 200 may be formed having at least two halves which each define a fastener aperture 208. A fastener 206 may then be inserted into the fastener aperture 208 to provide engagement between the two halves around the chain 202. When the chain 202 is employed, the rope-engaging aperture 210 should also be formed to accommodate the chain 202 such that the aperture 210 is formed having a substantially rectangular configuration with flanged ends for providing play during rotation of the beads around a pulley.

Preferably, each bead 18 and each master and filler tooling bead 110 an 112 has a substantially spherical configuration. By providing such a spherical configuration, the user may easily grasp the beads 18 and ascend or descend the bead chain 20. However, where the beads 18 are formed having non-spherical configurations, the master and filler tooling beads 110 and 112 should also be formed from such a non-spherical configuration. Additionally, the size of the beads 18, 110 and 112 should be sized to be hand-holdable by the user so as to be comfortable enough fit in the palm of a user's hand and provide maximum traction when disposed at locations on the rope 16 in substantially side-by-side configurations. To further enhance the user's grip on the bead chain 20, the beads 18, 110 and 112 may be formed having an outer surface fabricated from an elastomeric material. The elastomeric material provides enhanced grip to the user's hands yet a plastic or plastic/rubber hybrid material may be employed to accomplish the same, such as Santoprene or Geolast. Preferably, the outer surface of the beads 18, 110 and 112 are formed to feel soft and comfortable to the user's hand yet the inside cast is sufficiently rigid to retain it's shape and configuration. It is also contemplated that the beads 18, 110 and 112 will be filled with a glass material or hardened plastic to ensure rigidity to form the support ridges 134.

Each master and filler tooling bead 110 and 112 may be formed having first and second respective bead portions 32 and 34. Each of the first and second bead portions 32 and 34 may define at least one fastener hole perpendicularly formed with respect to the rope-engaging aperture. Preferably, first and second fastener holes 36 and 38 are provided which are perpendicularly formed with respect to the rope-engaging aperture. To allow the bead portions 32 and 34 to be joined together over the rope 16, first and second fasteners 48 and 50 insertable through the first and second respective fastener holes 36 and 38 of the first and second bead portions 32 and 34 may be provided so as to fixedly engage the first and second bead portions 32 and 34 to each other. Advantageously, the master and filler tooling beads 110 and 112 have a multi-piece configuration. By forming the master and filler tooling beads 110 and 112 in such a manner, the beads 110 and 112 may be detachable from the rope 16 and replaced with other objects and/or replacement beads 18. Thus, if the material/outer coating/palmar support surface deteriorates and requires replacement, the specific bead 18 may be removed from the bead chain 20 and replaced. Otherwise, the entire bead chain 20 might need to be removed from the first and second rope pulleys 12 and 14 so as to allow for individual replacement of beads 20 and/or an entirely new bead chain 20.

As further shown in FIGS. 4 and 5, the master and filler tooling beads 110 and 112 may be formed having first and second bead portions 32 and 34. Each of the first and second bead portions 32 and 34 have a first side 52 defining a substantially domed or half-spherical surface and a second side 54 defining a substantially planar surface. The planar surface 54 defines a linear channel 30 through a central portion thereof. The planar surface 54 of each of the respective first and second bead portions 32 and 34 are abuttable to each other such that each linear channel 30 may be placed into contact with at least a portion of the rope 16. With respect to the linear channel 30, the liner channel 30 is preferably formed on each of the first and second bead portions 32 and 34 as a substantially half-cylindrical cut-out. For example, the linear channel 30 may be defined to snugly accommodate a length of the rope 16 as shown in FIG. 5. This linear channel 30 may be coated, formed and/or lined with a rigid metallic material or other type of material which enhances rigidity. Alternatively, the linear channel 30 may be formed from a hard plastic material, as with the remaining portions of the first and second bead portions 32 and 34. To allow the first and second bead portions 32 and 34 to tightly grasp the rope 16, each of the first and second bead portions 32 and 34 may further define first and second fastener holes 36 and 38 perpendicularly formed with respect to the respective linear channel 30. Additionally, first and second fasteners 48 and 50 may be provided which are insertable through the first and second fastener holes 36 and 38 of the first and second bead portions 32 and 34 respectively so as to fixedly engage the first and second bead portions 32 and 34 to each other.

As shown in FIGS. 6, 7 and 7A, each bead 18 is preferably formed having a plurality of support ridges 134 extending radially from a center portion of each bead 18. Such support ridges 134 may be formed from a hardened plastic or glass material and arranged throughout the bead 18 to provide rigidity in the core of each bead 18 while providing grippable support for the user's hands.

To allow the beads 18 to engage the rope 16, at least a portion of each bead 18 may define a rope-engaging aperture 30 therethrough. The aperture 30 may be formed so as to receive the exercise rope 16 therethrough. Thus, engaging the bead 18 to the rope 16 allows the bead 18 to substantially surround a diameter of the rope 16.

As shown in FIG. 6, to further ensure rigidity of the bead, the rope engaging aperture 30 may form a support liner 138 formed from a substantially rigid metallic material, e.g. aluminum or steel. The support liner 138 is preferably cylindrical in shape complimentary to the size and shape of the rope-engaging aperture 30. The support liner 138 may be formed having flanged ends which provide play at each end of the bead 18 and allow the rope 16 to move freely and accommodate rotation of the beads 18 around the first and second rope pulleys 12 and 14.

As shown in FIGS. 7 and 7A, the beads 18 may be formed having a curved configuration through a central portion of each bead. The curved configuration provides play for the rope 16 to freely move during rotation of the first and second rope pulleys 12 and 14. As illustrated in further detail in FIG. 7A, each of the beads 18 may be formed having female and male connectors 140 and 142. By providing the female and male connectors 140 and 142, gradual wear and tear of the beads 18 during continual use is reduced and/or eliminated. Due to the grippable coating of the beads 18, use of the bead chain 20 causes the beads 18 placed in side-by-side or end-to-end positions to rub up against each other, thereby causing slight deteriorations in the shape of the beads 18. During rotation of the first and second rope pulleys 12 and 14, the beads 18 tend to crunch together and the male connector 140 advantageously mates with the female connector in part so as to allow for smooth and continuous rotation of the bead chain 20 around the pulleys 12 and 14.

As shown in FIGS. 3, 3A and 3B, the linkable beads 140 may be used to form the bead chain 20. Each linkable bead 140 may be define a male and female link ends 160 and 162, the male link end 162 forming a substantially cylindrical-shaped male link aperture 148 and the female link end 160 forming a substantially cylindrical-shaped female link aperture 150. The male link end 162 may be insertable into the female link end 160 and retained therein via an independent link plug 146. The link plug 146 may be insertable through the female link aperture 150 and through the male link aperture 148 so as to allow the linked beads 140 to be detachable engageable to each other and pivotable against each other.

Figure 9:
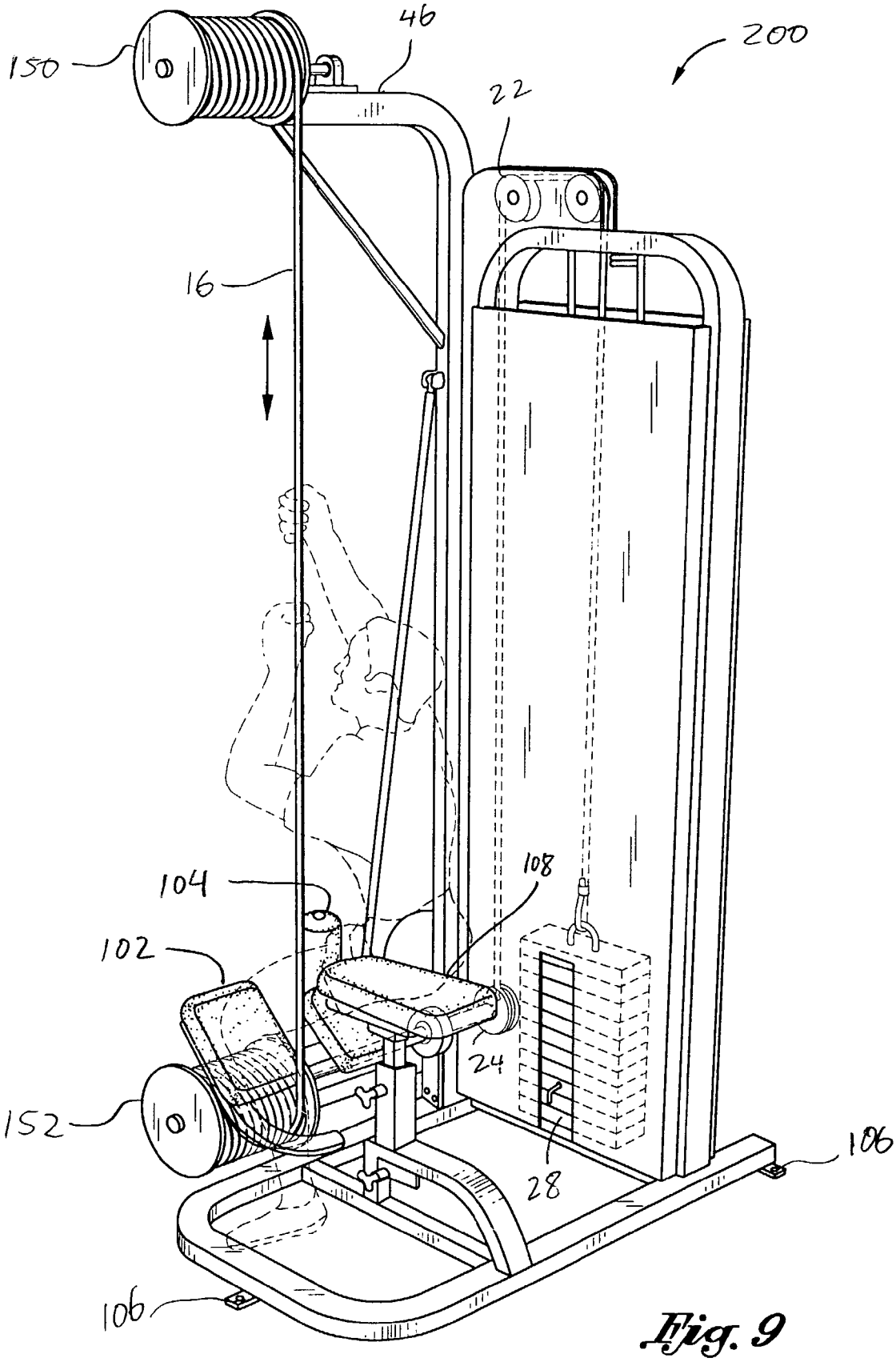
FIG. 9 is a plan view of the present invention illustrating the use of first and second rope spools having a length of rope disposable therebetween.

As shown in FIG. 9, the present invention may also be formed having a body 200 which is substantially the same as the body illustrated in FIG. 1 yet utilizes a different gripping mechanism. In this respect, first and second rope spools 150 and 152 may be formed so as to allow a rope 16 to be disposable therebetween. The first spool 150 may be placed above the second spool 152 such that the user 100 may pull upward or downward on the rope 16 and the rope winds up or down on each spool 150 and 152. In this respect, any type of elongated flexible members may be used to feed between the spools 150 and 152.

It is also contemplated that the beads 18 may be utilized for other gripping devices. Any device which requires elongated poles or ropes for exercising or retaining grip may benefit from the use of the beads 18. For example, a device may be formed which includes a length of rope having a plurality of the beads 18 formed in accordance with the present invention positioned on locations at the rope in a generally side-by-side configuration. It is also contemplated that the beads 18 may be spaced apart to provide for applications which require the user to grasp the rope itself. When placing the beads 18 side-by-side, such a resulting device could replace existing upper body exercise device bars and further provide for a flexible length of rope having the beads thereon which is attachable to existing exercise devices. Other uses of the beads 18 are anticipated in the field of exercise devices where gripping is advantageous.

Additional modifications and improvements of the present invention may also be apparent to those of ordinary skill in the art. Thus, the particular combination of parts described and illustrated herein is not intended to serve as limitations of alternative devices within the spirit and scope of the invention.

What is claimed is:

1. A rope climb simulator system for allowing a user to simulate ascending and descending rope climbing exercises therewith, the system comprising:

a bead chain formed of a plurality of serially connected beads, each of the beads defining a palmar support portion graspable by the user's hands for moving the bead chain in first and second directions so as to simulate ascending and descending rope climbing exercises, respectively;

a resistance mechanism in mechanical communication with the bead chain, the resistance mechanism providing bidirectional resistance to the bead chain by urging counteracting movements of the bead chain in either the first direction or the second direction to move the resistance mechanism from a stacked position to an elevated position; and wherein the bead chain and the resistance mechanism cooperate to impart flexion of first and second sets of the user's muscles during the ascending and descending rope climbing exercises respectively.

2. The system as in claim 1 further comprising first and second rope pulleys disposed in generally spaced relation, the first rope pulley being disposed above the second rope pulley so as to allow the bead chain to travel bidirectionally therebetween.

3. The system as in claim 2 wherein at least one of the first and second rope pulleys defines a seating recess formed about at least an outer portion thereof.

4. The system as in claim 3 wherein the seating recess defines a pair of inner walls disposed in parallel relation to face each other, the inner walls defining an intermediate surface extending perpendicularly therebetween, the inner walls and the intermediate surface being collectively formed to receive the bead chain within the seating recess during rotational movement thereof.

5. The system as in claim 2 wherein the resistance mechanism further includes first and second resistance pulleys rotatably mounted in generally spaced relation.

6. The system as in claim 5 wherein the resistance mechanism further includes a resistance weight in mechanical communication with one of the first and second resistance pulleys, wherein the weight imparts resistance on the bead chain as the weight is moved between the starting position and a disposed position.

7. The system as in claim 1 wherein the palmar support portion is formed having a substantially spherical configuration to accommodate the user's fingers and hands.

8. The system as in claim 1 wherein the palmar support portion defines an elastomeric palmar support surface thereabout for providing traction to the user's fingers and hands.

9. The system as in claim 1 wherein the first set of muscles includes deep flexor muscle of fingers, superficial flexor muscle of fingers, ulnar flexor muscle of wrist, short flexor muscle of little finger, short flexor muscle of thumb, long flexor muscle of thumb, adductor muscle of thumb, palmar interosseous muscles, pronater muscles, brachial muscle, brachioradial muscle, latissimus dorsi muscle, triceps muscle of arm, and pectoral muscles.

10. The system as in claim 1 wherein the second set of muscles includes deep flexor muscle of fingers, superficial flexor muscle of fingers, ulnar flexor muscle of wrist, short flexor muscle of little finger, short flexor muscle of thumb, long flexor muscle of thumb, adductor muscle of thumb, palmar interosseous muscles, pronater muscles, brachial muscle, brachioradial muscle, biceps muscle of arm, deltoid muscle, trapezius muscle, and scapula.

11. The system of claim 1 wherein the resistance mechanism imparts progressively increased resistance as the bead chain moves in the first direction.

12. The system of claim 1 wherein the resistance mechanism imparts progressively increased resistance as the bead chain moves in the second direction.

13. The system of claim 1 wherein the resistance mechanism is operative to exercise flexor muscles.

14. The system of claim 1 wherein the resistance mechanism is operative to exercise extensor muscles.

15. A rope climb simulator system for allowing a user to simulate ascending and descending rope climbing exercises therewith, the system comprising:

a bead chain formed of a plurality of serially connected beads, each of the beads defining a palmar support portion graspable by the user's hands for moving the bead chain in first and second directions so as to simulate ascending and descending rope climbing exercises, respectively;

a resistance mechanism in mechanical communication with the bead chain, the resistance mechanism providing bidirectional resistance to the bead chain by urging counteracting movements of the bead chain when the user pulls the bead chain to move the resistance mechanism from a stacked position, the bead chain being pulled in either a first direction and a second direction;

wherein the bead chain and the resistance mechanism cooperate to impart flexion of first and second sets of the user's muscles during the ascending and descending rope climbing exercises respectively;

first and second rope pulleys disposed in generally spaced relation, the first rope pulley being disposed above the second rope pulley so as to allow the bead chain to travel bidirectionally therebetween;

at least one of the first and second rope pulleys defines a seating recess formed about at least an outer portion thereof; and the seating recess defines a pair of inner walls disposed in narallel relation to face each other, the inner walls defining an intermediate surface extending perpendicularly therebetween, the inner walls and the intermediate surface being collectively formed to receive the bead chain within the seating recess during rotational movement thereof;

wherein the intermediate surface of the second rope pulley defines a plurality of bead engagement recesses disposed serially therealong, each of the bead engagement recesses being sized and configured to engage a respective one of the beads.

16. The system as in claim 15 wherein each of the bead engagement recesses are formed having a recess bottom and a substantially circular engagement rim, the recess bottom and engagement rim defining an arcuately continuous portion therebetween for allowing the beads to roll thereinto during rotational movement of the bead chain.

17. A rope climb simulator system for allowing a user to simulate ascending and descending rope climbing exercises therewith, the system comprising:

a bead chain formed of a plurality of serially connected beads, each of the beads defining a palmar support portion graspable by the user's hands for moving the bead chain in downward and upward directions;

a resistance mechanism in mechanical communication with the bead chain, the resistance mechanism providing resistance to the bead chain by urging counteracting movements of the bead chain when the user pulls in a first direction and a second direction;

wherein the bead chain and the resistance mechanism cooperate to impart flexion of first and second sets of the user's muscles during the ascending and descending rope climbing exercises respectively;

first and second rope pulleys disposed in generally spaced relation, the first rope pulley being disposed above the second rope pulley so as to allow the bead chain to travel bidirectionally therebetween;

wherein the resistance mechanism further includes first and second resistance pulleys rotatably mounted in generally spaced relation;

wherein the resistance mechanism further includes a resistance weight in mechanical communication with one of the first and second resistance pulleys, wherein the weight imparts resistance on the bead chain as the weight is moved between the starting position and a disposed position;

wherein the resistance mechanism further includes a resistance belt engagable with one of the first and second rope pulleys, the resistance belt having a first end attached to one of the first and second rope pulleys, the resistance belt having a second end attached to the resistance weight; and wherein one of the first and second rope pulleys is formed having a winding member for receiving the resistance belt therearound so as to provide progressively increasing and decreasing resistance to the user during the first and second movements of the bead chain respectively.

18. The system as in claim 17 wherein the winding member further includes a substantially cylindrical rod axially attached thereto and engagable to one of the first and second rope pulleys.

19. The system as in claim 18 further comprising a bidirectional centrifugal clutch placable into mechanical communication with the rod, the clutch being configured to engage the rod and prevent rotational movement thereof in response to sudden acceleration of the rod.

20. A rope climb simulator system for allowing a user to simulate ascending and descending rope climbing exercises therewith, the system comprising:

a bead chain formed of a plurality of serially connected beads, each of the beads defining a palmar support portion as able by the user's hands for moving the bead chain in first and second directions so as to simulate ascending and descending rope climbing exercises, respectively;

a resistance mechanism in mechanical conmiunication with the bead chain, the resistance mechanism providing bidirectional resistance to the bead chain by urging counteracting movements of the bead chain when the user pulls the bead chain to move the resistance mechanism from a stacked position, the bead chain being pulled in either a first direction and a second direction; and wherein the bead chain and the resistance mechanism cooperate to impart flexion of first and second sets of the user's muscles during the ascending and descending rope climbing exercises respectively;

comprising first and second rope pulleys disposed in generally spaced relation, the first rope pulley being disposed above the second rope pulley so as to allow the bead chain to travel bidirectionally therebetween;

the resistance mechanism further includes first and second resistance pulleys rotatably mounted in generally spaced relation; and the resistance mechanism further includes a resistance weight in mechanical communication with one of the first and second resistance pulleys, wherein the weight imparts resistance on the bead chain as the weight is moved between the starting position and a disposed position;

wherein the resistance mechanism further includes a resistance belt engagable with one of the first and second rope pulleys, the resistance belt having a first end attached to one of the first and second rope pulleys, the resistance belt having a second end attached to the resistance weight.

* * * * *